US005471181A

United States Patent [19]

Park

[11] Patent Number: 5,471,181

[45] Date of Patent: Nov. 28, 1995

[54] INTERCONNECTION BETWEEN LAYERS OF STRIPLINES OR MICROSTRIP THROUGH CAVITY BACKED SLOT

[75] Inventor: Pyong K. Park, Agoura Hills, Calif.

[73] Assignee: Hughes Missile Systems Company, Los Angeles, Calif.

[21] Appl. No.: 207,765

[22] Filed: Mar. 8, 1994

[51] Int. Cl.[6] ..... H01P 5/00

[52] U.S. Cl. ..... 333/246; 333/260

[58] Field of Search ..... 333/24 R, 246, 333/260

[56] References Cited

U.S. PATENT DOCUMENTS

| | | | |
|---|---|---|---|
| 3,771,075 | 11/1973 | Phelan | 333/246 |
| 3,868,594 | 2/1975 | Cornwell et al. | 333/238 X |
| 3,974,462 | 8/1976 | Fassett | 333/22 R |
| 4,130,822 | 12/1978 | Conroy | 333/246 X |
| 5,093,639 | 3/1992 | Franchi et al. | 333/246 X |
| 5,150,088 | 9/1992 | Virga et al. | 333/238 |

FOREIGN PATENT DOCUMENTS

| | | |
|---|---|---|
| 0378905 | 12/1989 | European Pat. Off. . |
| 0465994A1 | 7/1991 | European Pat. Off. . |
| 0383292 | 2/1990 | Japan . |
| WO93/05543 | 8/1992 | WIPO . |

OTHER PUBLICATIONS

Handbook of Tri–Plate Microwave Components Sanders Assoc., Nashua, N.H., 1956, pp. 86 & 87 relied on, TK787053.

Transactions of the Institute of Electronics and Communication Engineers of Japan, Section E, vol. E69, No. 4, Apr. 1986 Tokyo JP, pp. 333–334, O. Ishida et al. 'An asymmetrical suspended stripline directional coupler' *FIG. 3*.

Electronics Letters, vol. 22, No. 5,27 Feb. 1986 Stevenage GB, pp. 281–183, T. Kitazawa et al. 'Dispersion Characteristics of unsymmetrical broadside–coupled striplines with anisotropic substrate' *FIG. 3*.

IEEE Transactions on Microwave Theory and Techniques, vol. 34, No. 12, Dec. 1986 New York US, pp. 1457–1463, suspended striplines' *FIGS. 2, 6*.

Electronics Letters, vol. 29, No. 11, 27 May 1993 Stevenage GB, pp. 1021–1022, XP 000373934, M. EL Yazidi et al. 'Analysis of aperture–coupled circular microstrip antenna' *FIGS. 1, 2*.

*Primary Examiner*—Paul Gensler

*Attorney, Agent, or Firm*—Charles D. Brown; Randall M. Heald; Wanda K. Denson-Low

[57] ABSTRACT

An interconnection between layers of stripline or microstripline in a multilayer microwave circuit assembly, through electromagnetic coupling. The adjacent layers (52 and 54) utilize a common ground plane layer (56), and a U-shaped coupling slot (64) is formed in the common ground plane. To eliminate undesirable coupling to other transmission line modes, the coupling slot is enclosed by a cavity (70) for each layer. The cavity size is selected so that no cavity mode exists, and to prevent formation of unwanted transmission modes. The "U" shape of the slot reduces the size of the cavity. The interconnection can be used with adjacent layers of stripline, microstrip line, or stripline and microstrip line.

28 Claims, 5 Drawing Sheets

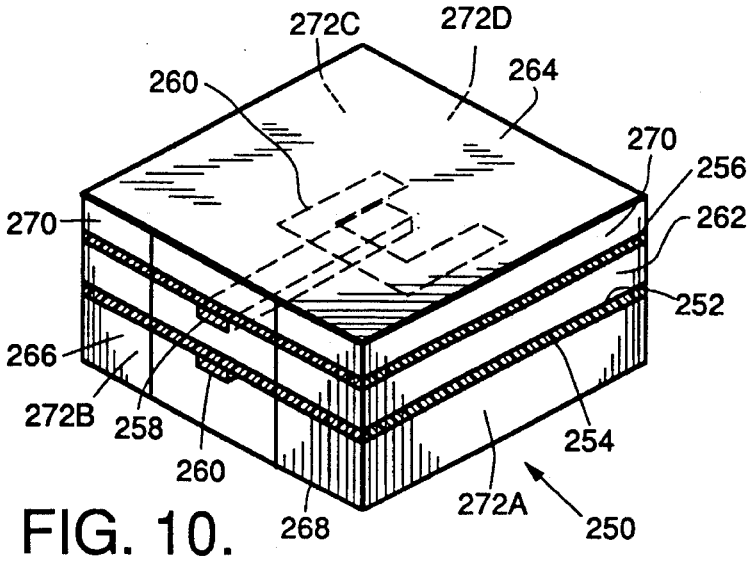
FIG. 10.
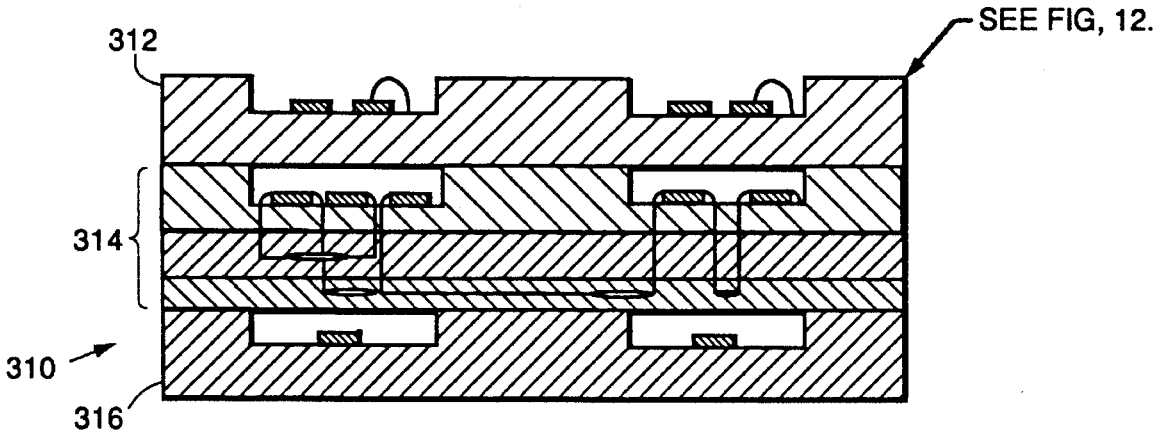
FIG. 11.
FIG. 12.
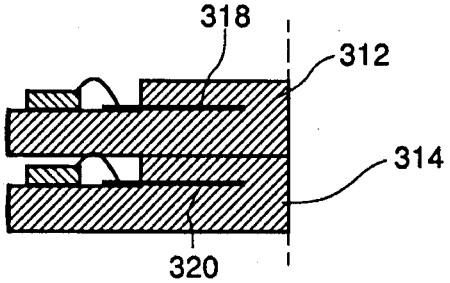

INTERCONNECTION BETWEEN LAYERS OF STRIPLINES OR MICROSTRIP THROUGH CAVITY BACKED SLOT

TECHNICAL FIELD

This invention relates to the interconnection of two stripline or microstrip transmission lines between two different layers of a multilayer microwave integrated circuit.

BACKGROUND OF THE INVENTION

Multiple layers of microwave transmission lines are commonly used to reduce the size of microwave circuits and improve their performance. Miniature microwave integrated circuit (MMIC) packaging commonly employs such multilayer technology.

Interconnections between layers has conventionally been accomplished by direct contact, e.g., by feed-through pins extending between layers in plated through holes, and which pins are soldered to transmission line conductors in the layers. Such interconnections are relatively difficult and expensive to fabricate. Moreover, once the pins have been soldered in place, disassembly of the layers requires that the solder connections be broken or disassembled. This significantly increases the difficulty of trouble-shooting malfunctions or testing the assembly.

In an attempt to provide a multilayer assembly which can more readily be disassembled, interconnection between microwave circuits on different layers has been accomplished by press contact with a mini-bellows interconnect element extending between the layers. Such bellows elements are not soldered to the conductors, and therefore the layers may more readily be disassembled for repair or testing. If the contact surfaces of the bellows or the conductors to which the bellows make contact are dirty, the effectiveness of the interconnection will be impaired.

SUMMARY OF THE INVENTION

In a multilayer microwave circuit, an electromagnetic coupling interconnection between first and second microwave circuit conductors in first and second different layers is described. The interconnect comprises a ground plane disposed between the first and second layers, and a coupling slot defined in the ground plane between the two conductors. The slot has a midsection extending substantially transverse to the first and second conductors. For efficient energy coupling, the slot has an effective electrical length equivalent to one half wavelength at a frequency of operation. To conserve coupling area, the slot is substantially U-shaped, with arm sections disposed substantially perpendicular to the slot midsection.

The interconnection further includes a cavity defining enclosure for enclosing the interconnection area. This prevents unwanted propagation of cavity modes or undesired transmission line modes.

BRIEF DESCRIPTION OF THE DRAWING

These and other features and advantages of the present invention will become more apparent from the following detailed description of an exemplary embodiment thereof, as illustrated in the accompanying drawings, in which:

FIG. 10 shows an exemplary interconnection between an air stripline and a microstripline in adjacent layers of a multilayer circuit, in accordance with the invention.

FIGS. 11–13 are schematic diagrams illustrating an exemplary application of this interconnection invention to interconnect transmission lines on different layers of an RF processor on board a missile.

DETAILED DESCRIPTION OF THE PREFERRED EMBODIMENT

Overview of the Invention

This invention relies on electromagnetic coupling for the interconnection instead of direct contact. Stripline or microstrip line supports currents in both the conductor and its ground plane. If a slot is cut in the ground plane, the ground plane current is disturbed by the slot. As a result of this, the microwave energy is coupled to the slot and the slot is excited. If another, second stripline conductor is placed on the other side of a common ground plane from a first stripline conductor, microwave energy will couple from one stripline in one layer to the other stripline in the other layer. This invention takes advantage of this property to interconnect between transmission lines in different layers. However, the excited slot recognizes many different transmission lines (as an example, the parallel transmission line mode). In order to eliminate undesirable coupling to the other transmission line mode, the parallel plate TEM mode, the coupling slot is substantially enclosed by a cavity defined by the ground planes for the adjacent layers and by metallized sides extending between the adjacent layers. The cavity size should be small enough (0.6 by 0.6 free space wavelength) that no cavity mode exists. The cavity mode always adds undesirable extra losses.

An efficient coupling slot needs to be one-half wave length long at the mid-band frequency, which takes sizable space. In order to reduce the cavity size, a U-shaped slot is used. The U-shaped slot provides substantially the same effective electrical length, but in a more compact slot area. For the suspended air stripline, the cavity size can be reduced to smaller than an area of 0.5 by 0.5 free space wavelength. For the dielectric loaded stripline (for example, aluminum nitride substrate for MMIC circuits), the cavity size can be further reduced to smaller than an area of 0.17 by 0.17 free space wavelength.

Interconnection between Suspended Air Striplines

Figure 1:
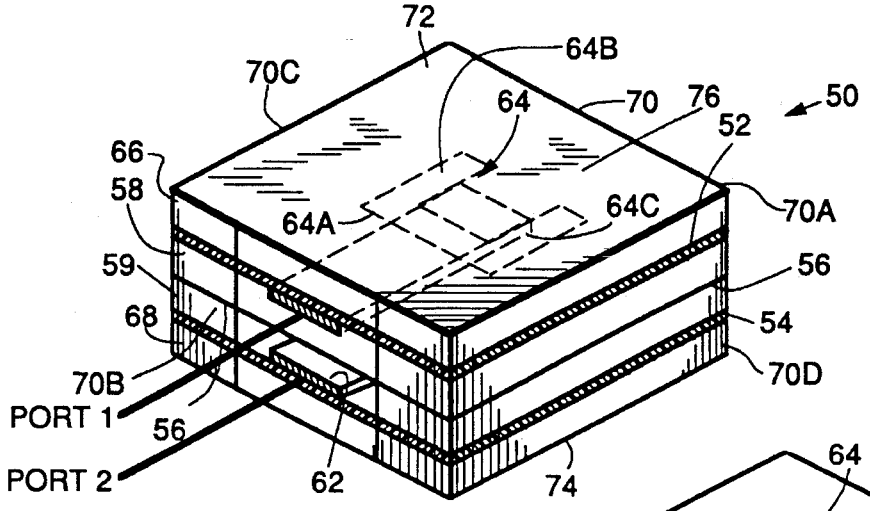
FIG. 1 is an isometric view of a section of multilayer microwave circuitry employing electromagnetic coupling interconnection between air stripline circuit conductors in different layers in accordance with the invention.
Figure 2:
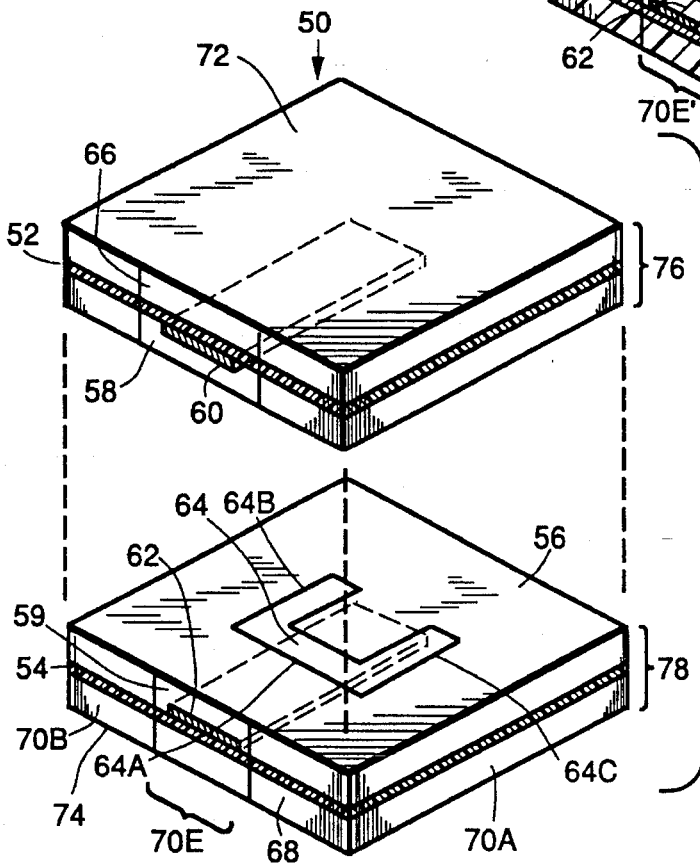
FIG. 2 is a partially exploded view of the circuitry of FIG. 1.

FIGS. 1 and 2 illustrate a first exemplary embodiment of the invention, wherein suspended air striplines are interconnected. FIG. 1 shows the interconnection in assembled form; FIG. 2 shows the interconnection in partially exploded form. In the illustrated example, dielectric substrates 52 and 54 are suspended in air on either side of a ground plane layer 56 to form air gaps 58 and 59. Center conductor lines 60 and 62 are defined on facing surfaces of the substrates 52 and 54, and are disposed in an aligned relationship so that the line 60 is disposed directly above line 62. Respective air gaps 66 and 68 are defined between substrate 52 and upper groundplane 72 and between substrate 54 and lower groundplane 74.

In accordance with the invention, a U-shaped slot 64 is defined in the ground plane layer 56. The slot midsection 64A is disposed between and transverse to the suspended air striplines 60 and 62. The arm sections 64B and 64C of the slot are at a right angle to the midsection 64A, and are parallel to the suspended air striplines 60 and 62. 0f course, a straight coupling slot could alternatively be employed by simply "straightening out" the arm sections; however, the greater length on either side of the suspended air striplines increases the size of the interconnection.

To eliminate undesirable coupling to other transmission modes, conductive cavities 76 and 78 cover the coupling slot 64 on each side of the groundplane 56. Conductive walls 70A–70D extend around the coupling slot 64 substantially perpendicular to the substrates 52 and 54, and, together with conductive top and bottom groundplanes 72 and 74, define the upper and lower cavities 76 and 78. Wall 70E includes an opening 70E permitting the conductors 60 and 62 to enter the interconnection area. Cavity 76 encloses the upper air stripline including the center conductor 60; cavity 78 encloses the lower air stripline including the center conductor 62.

In a particular application to provide interconnection in the 8.4 to 11.6 Ghz frequency band, the various elements of the interconnect 50 have the following dimensions. The substrates 52 and 54 are formed of Duroid having a thickness of 0.015 inches, and are each spaced from the ground plane 56 by 0.061 inch air gaps 58 and 59. The strip width of center conductors 60 and 62 is 0.180 inches. The slot 64 has a width of 0.06 inches. The distance between the respective outer edges of the arms 64B and 64C is 0.52 inches. The cavity 70, comprising cavities 76 and 78, is 0.58 inches by 0.58 inches by 0.173 inches. Small openings are defined in the cavity wall 70B to permit the striplines 60 and 62 to enter the cavity without shorting. The openings have a typical size of 0.25 by 0.173 inches.

Interconnection between Dielectric Loaded Striplines

Figure 3:
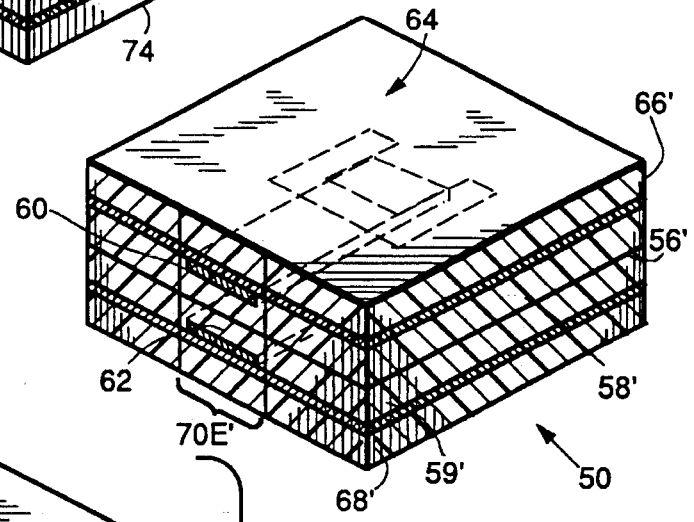
FIG. 3 illustrates an interconnection between dielectric loaded striplines in different layers in accordance with the invention.

It will be understood that an interconnection between layers of dielectric loaded stripline could be formed in a very similar manner to the suspended air stripline interconnection illustrated in FIGS. 1 and 2. It would only be necessary to replace the air gaps 58, 59, 66 and 68 with dielectric loading layers, thinner than the air gaps. This would further reduce the thickness of the transition. Such an interconnection is shown in FIG. 3, where dielectric substrates 58', 59', 66' and 68' have replaced the air gaps. In other respects, the interconnection 50' is similar to the interconnection 50 of FIGS. 1 and 2. Thus, all sides of the interconnection are metallized, except for the opening 70E for the stripline input and output ports.

Interconnection between Microstripline Layers

Figure 4:
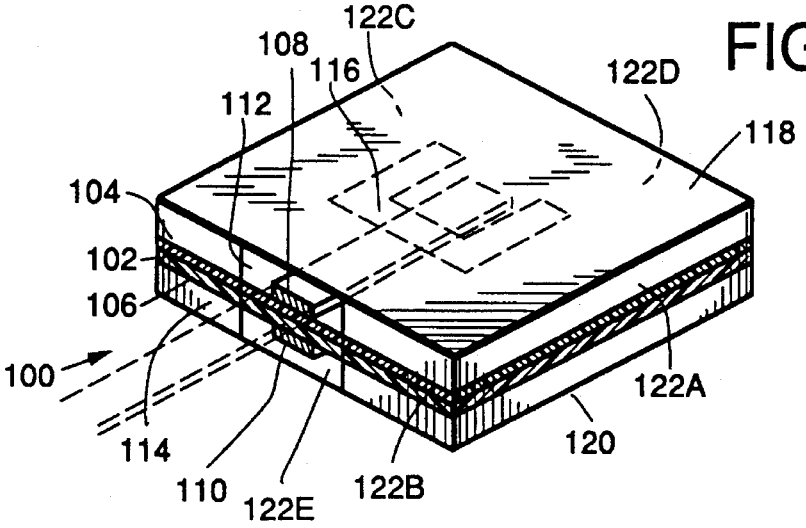
FIG. 4 illustrates an interconnection embodying this invention between microstriplines in adjacent layers of a multilayer microwave circuit.

The invention may also be used to electromagnetically interconnect adjacent layers of microstripline, as shown by the interconnection 100 of FIG. 4. Here, a center ground plane 102 is sandwiched between top and bottom dielectric substrates 104 and 106. Microstrip conductor lines 108 and 110 are formed on non-facing surfaces of the substrates 104 and 106, one above the other. A U-shaped coupling slot 116 is formed in the center ground plane 102. Air gaps 112 and 114 are defined between the respective substrates 104 and 106, and the upper and lower ground planes 118 and 120. Upper and lower cavities are formed by upper and lower ground planes 118 and 120, in combination with the center ground plane 102 and conductive side walls 122A–122D. An opening 122E is formed in wall 122B to provide an opening for the microstrip input and output ports.

Fabrication of the Cavities

Figure 5:
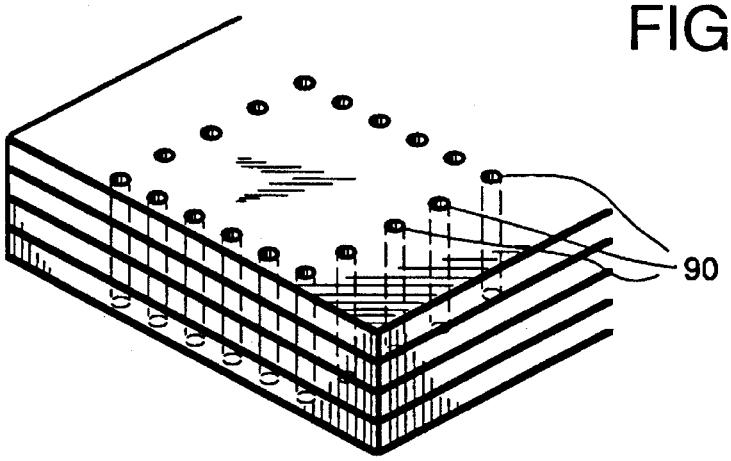
FIGS. 5–8 illustrate several construction techniques for fabricating the conductive cavities enclosing the coupling slot in accordance with the invention.
Figure 6:
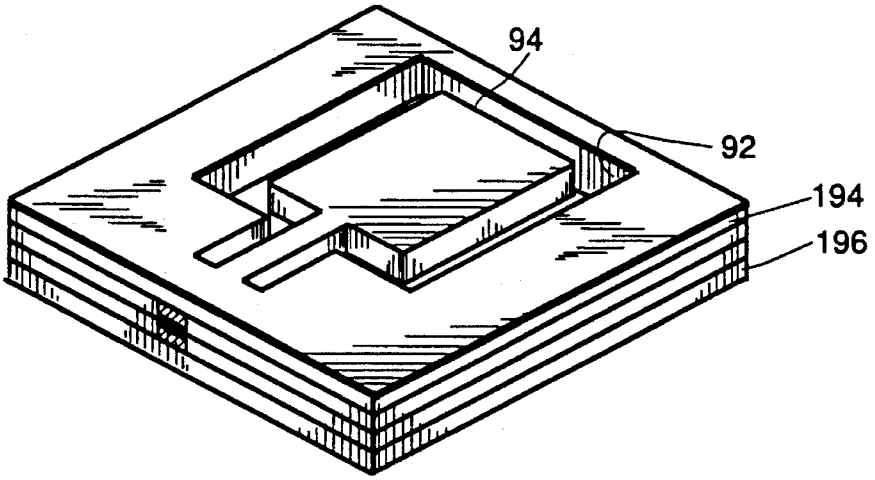
Figure 7:
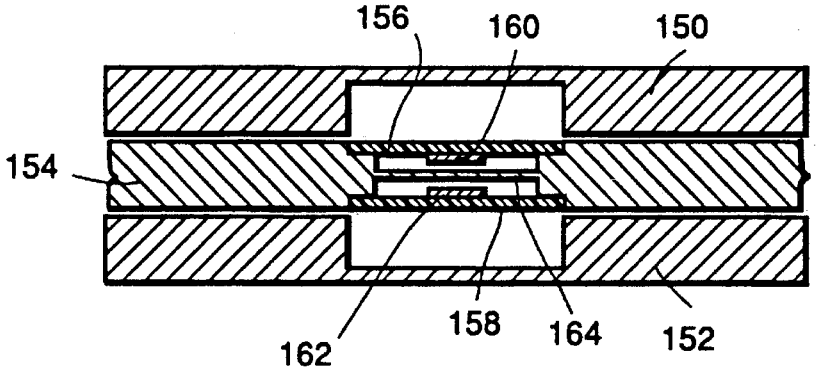

There are many known techniques for fabricating the cavities in a multilayer microwave circuit assembly. For example, the cavity walls 70A–70D of FIGS. 1 and 2 need not be continuous wall members, and may be defined by a series of aligned holes formed in the different substrate and ground plane layers, and plated through or connected by conductive pins. FIG. 5 illustrates such a fabrication technique, wherein a plurality of plated through holes 90 define the cavity side walls. Alternatively, in a multilayer assembly, the substrates 194 and 196 can be cut out around the cavities, and the sidewalls plated, as shown in FIG. 6. Here, a larger opening 92 is cut around the cavity outline, and the resulting walls of the dielectric loaded striplines are plated to form the cavity sidewalls 94. Top and bottom conductive covers (not shown) are then added to complete the conductive cavities. Another technique for forming the cavities in an air stripline interconnection is shown in FIG. 7, where top and bottom metallic or metallic plated covers 150 and 152 sandwich a middle metallic member 154 defining the common ground plane containing the coupling slot. Dielectric substrate layers 156 and 158 support the stripline conductors 160 and 162. The U-shaped coupling slot would be located in the thin portion 164 of member 154.

Figure 8:
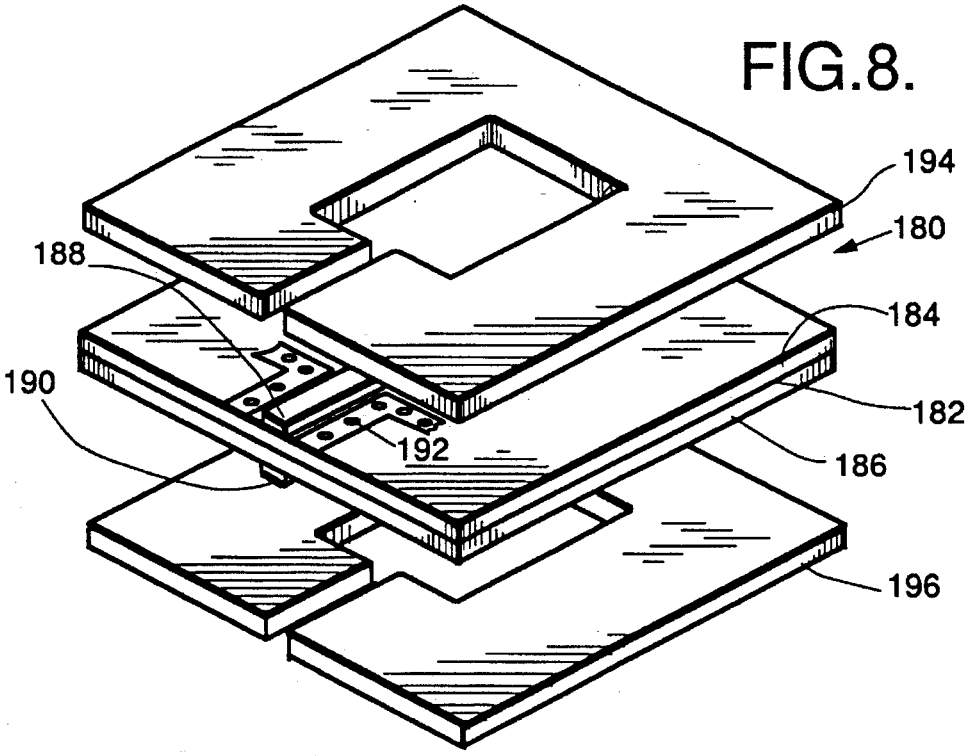

FIG. 8 illustrates one technique for fabricating the cavity conductive walls in an interconnection for interconnecting adjacent microstriplines. Here, interconnection 180 includes the center ground plane 182 in which is formed the coupling slot, sandwiched by dielectric substrates 184, 186 which carry the microstrip conductors 188,190. Plated through holes 192 are used to channelize around the microstriplines and the boundaries of the cavities. Cutouts are formed in top and bottom substrates 194 and 196 to define top and bottom air gaps. The resulting interior walls of the substrates 194 and 196 are plated, and the various layers bonded together. Top and bottom conductive covers (not shown) are then added to complete the conductive cavities.

Interconnection between Stripline and Microstripline

Figure 9:
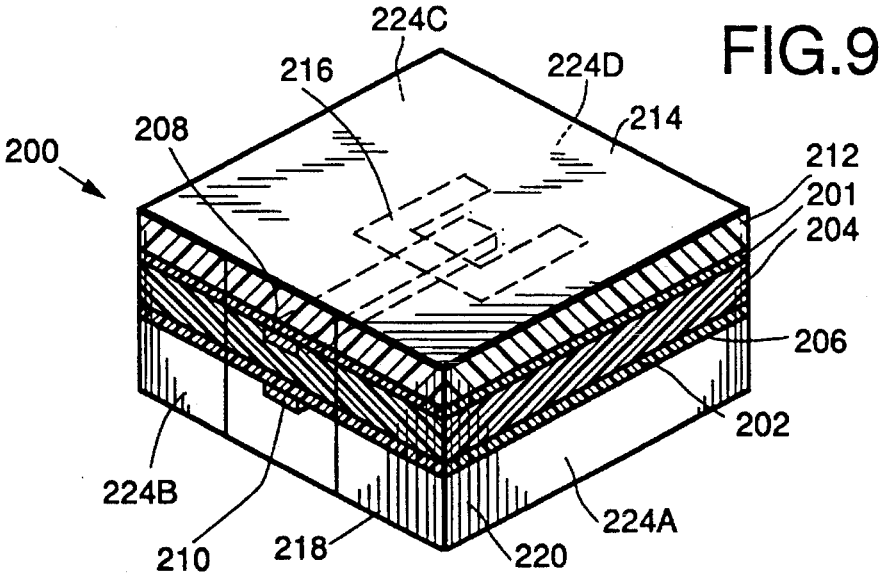
FIG. 9 shows an exemplary interconnection between a dielectric loaded stripline and a microstripline in adjacent layers of a multilayer circuit, in accordance with the invention.

The invention can also permit interconnection between different types of transmission lines. FIG. 9 shows an interconnection 200 between dielectric loaded stripline and microstripline. A center ground plane 202 has formed therein the coupling slot 216, and is sandwiched between dielectric substrates 204 and 206. The stripline conductor 208 and the microstripline conductor 210 are formed on non-facing surfaces of the substrates 201 and 206 in an aligned relationship. A stripline loading dielectric substrate 212 is disposed between the substrate 201 and the top ground plane 214. The bottom ground plane 218 is spaced from the lower surface of the substrate 206 to define the microstripline air gap 220. The sidewalls 224A–D are conductive to define the cavity walls.

FIG. 10 shows an interconnection 250 between suspended air stripline and microstripline. The center ground plane 252 has formed therein the U-shaped coupling slot 260. Adjacent the bottom surface of the ground plane 252 is the microstripline dielectric substrate 254, on the lower surface of which is formed the microstrip conductor line 260. A stripline dielectric substrate 256 is spaced from the upper surface of the ground plane by air gap 262, and has formed on the lower surface thereof the stripline conductor 258. An air gap 270 separates the top ground plane 264 from the substrate 256. Similarly, air gap 266 separates the microstrip substrate 254 from bottom ground plane 268. Conductive side walls 272A–D complete the upper and lower cavities.

Application for Missile RF Processor

Figure 13:
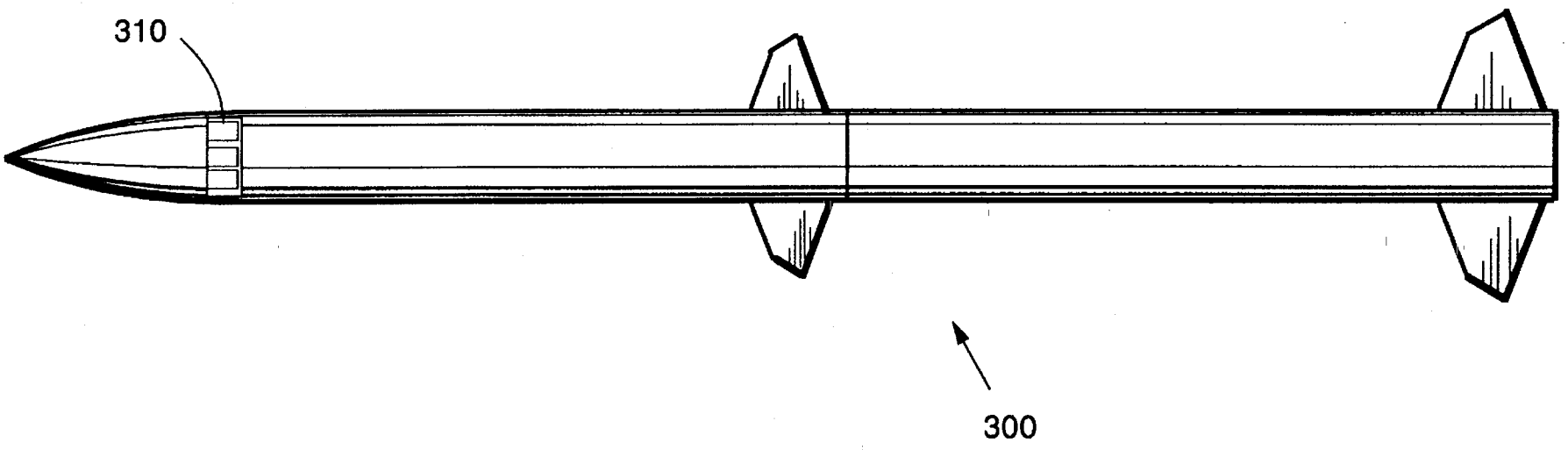

One exemplary application for the interconnection in accordance with the invention is in a missile radar processor, as shown in FIGS. 11–13. The missile 300 includes an RF processor 310, which includes an RF shelf 312, an IF shelf 314 and a baseband shelf 316. An exemplary interconnection in accordance with the invention via a cavity backed slot is made between stripline 318 in the RF shelf and stripline 320 in the IF shelf.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In a multilayer microwave integrated circuit, an electromagnetic coupling interconnection operative at microwave frequencies between first and second microwave circuit conductors in first and second different layers of said circuit, comprising a first ground plane disposed between said first and second layers, a coupling slot defined in said first ground plane, said slot having an effective electrical length equivalent to one half wavelength at a frequency of operation, said slot further having a midsection extending substantially transverse to said first and second conductors, and conductive cavity-defining means for completely surrounding said interconnection coupling slot, said interconnection ground plane and said interconnection circuit conductors with conductive surfaces defining first and second cavities, said first circuit conductor disposed within said first cavity, said second circuit conductor disposed within said second cavity, said conductive surfaces for preventing coupling to parallel plate transmission line modes.

2. The interconnection of claim 1 wherein said slot is substantially U-shaped, with arm sections disposed substantially perpendicular to said midsection.

3. The interconnection of claim 2 wherein said first and second conductors overlay one another at a coupling area, said slot defined in said ground plane between said conductors.

4. The interconnection of claim 1 wherein said first conductor comprises a microstrip conductor defined on a first surface of a first dielectric substrate, said second conductor comprises a microstrip conductor defined on a second surface of a second dielectric substrate, said first surface facing in an opposite direction to said second surface, said first and second dielectric substrates sandwiching said ground plane, wherein said interconnection provides electromagnetic coupling between said strip conductors on said first and second layers.

5. The interconnection of claim 1 wherein said first conductor comprises a first stripline conductor formed on a first dielectric surface, said second conductor comprises a second stripline conductor formed on a second dielectric surface, said conductors spaced from said ground plane.

6. The interconnection of claim 5 further comprising dielectric loading between said first dielectric surface with said first conductor and said ground plane, and between said second dielectric surface with said second conductor and said ground plane.

7. The interconnection of claim 1 wherein said first microwave circuit conductor is a microstripline conductor, and said second microwave circuit conductor is a stripline conductor.

8. The interconnection of claim 1 wherein each of said first and second cavities has a size to prevent formation of cavity propagation modes.

9. The interconnection of claim 1 wherein said cavity-defining means includes second and third conductive ground plane surfaces disposed substantially parallel to and spaced from said first ground plane surface, said first conductor disposed between and spaced from said first and second ground plane surfaces, said second conductor being disposed between and spaced from said first and third ground plane surfaces.

10. The interconnection of claim 9 wherein said cavity-defining means further includes sidewall surfaces extending transversely to said ground plane surfaces.

11. The interconnection of claim 10 wherein said first and second cavities have width and length dimensions which do not exceed 0.6 times the free space propagating wavelength within said cavities.

12. In a multilayer microwave integrated circuit, an electromagnetic coupling interconnection operative at microwave frequencies between first and second microwave circuit conductors in first and second different layers of said circuit, comprising:

a first ground plane disposed between said first and second layers;

a coupling slot defined in said ground plane, said slot having a midsection extending substantially transverse to said first and second conductors, said slot having an effective electrical length equivalent to one half wavelength at a frequency of operation; and cavity-defining conductive enclosure means for defining a cavity enclosure completely surrounding said coupling slot and electromagnetically coupled portions of said first and second microwave circuit conductors to prevent coupling to parallel plate transmission line modes, and wherein said cavity enclosure defines a cavity sufficiently small to prevent formation of cavity propagation modes.

13. The interconnection of claim 12 wherein said slot is substantially U-shaped, with arm sections disposed substantially perpendicular to said midsection.

14. The interconnection of claim 13 wherein said first and second conductors overlay one another at a coupling area, said slot defined in said first ground plane between said conductors.

15. The interconnection of claim 13 wherein said cavity defining means comprises a second ground plane spaced from and disposed on an opposite side of said first dielectric substrate from said first ground plane, and a third ground plane spaced from and disposed on an opposite side of said second dielectric substrate from said first ground plane, said first, second and third ground planes arranged in a substantially parallel relationship.

16. The interconnection of claim 15 wherein said cavity defining means further includes conductive side walls substantially enclosing a volume surrounding said coupling slot on each side of said first ground plane.

17. The interconnection of claim 16 further comprising dielectric loading between said first dielectric surface with said first conductor and said ground plane, and between said second dielectric surface with said second conductor and said ground plane.

18. The interconnection of claim 12 wherein said first conductor comprises a first stripline conductor defined on a first surface of a first dielectric substrate, said second conductor comprises a second stripline conductor defined on a second surface of a second dielectric substrate, said first and second surfaces facing each other, and wherein air gaps are defined between said first surface of said first substrate and said first ground plane, and between said first surface of said second substrate and said fist ground plane, wherein said interconnection provides electromagnetic coupling between stripline conductors on said first and second layers.

19. The interconnection of claim 12 wherein said cavity enclosure is no larger in two dimensions than 0.6 by 0.6 free space wavelengths at a wavelength of operation.

20. A guided missile, comprising:

an RF processor section, said section comprising a multilayer circuit having at least first and second layers, a first microwave circuit defined in said first layer and comprising a first circuit conductor, and a second microwave circuit defined in said second layer and comprising a second circuit conductor; and an electromagnetic coupling interconnection operative at microwave frequencies between said first and second microwave circuit conductors in said first and second different layers, comprising a first ground plane disposed between said first and second layers, and a coupling slot defined in said ground plane, said slot having a midsection extending substantially transverse to said first and second conductors, said slot having an effective electrical length equivalent to one half wavelength at a frequency of operation, and conductive cavity-defining means for completely surrounding said interconnection coupling slot and electromagnetically coupled portions of said first and second circuit conductors with conductive surfaces defining first and second cavities, said first circuit conductor disposed within said first cavity, said second circuit conductor disposed within said second cavity, said conductive surfaces for preventing coupling to parallel plate transmission line modes.

21. The guided missile of claim 20 wherein said slot is substantially U-shaped, with arm sections disposed substantially perpendicular to said midsection.

22. The guided missile of claim 21 wherein said first and second conductors overlay one another at a coupling area, said slot defined in said ground plane between said conductors.

23. The guided missile of claim 22 wherein said first and second conductors overlay one another at a coupling area, said slot defined in said ground plane between said conductors.

24. The guided missile of claim 20 wherein said first conductor comprises a microstrip conductor defined on a first surface of a first dielectric substrate, said second conductor comprises a microstrip conductor defined on a second surface of a second dielectric substrate, said first surface facing in an opposite direction to said second surface, said first and second dielectric substrates sandwiching said ground plane, wherein said interconnection provides electromagnetic coupling between center strip conductors on said first and second layers.

25. The guided missile of claim 20 wherein said first conductor comprises a first stripline conductor formed on a first dielectric surface, said second conductor comprises a second stripline conductor formed on a second dielectric surface, said conductors spaced from said ground plane.

26. The guided missile of claim 25 further comprising dielectric loading between said first dielectric surface with said first conductor and said ground plane, and between said second dielectric surface with said second conductor and said ground plane.

27. The guided missile of claim 20 wherein said first microwave circuit conductor is a microstripline conductor, and said second microwave circuit conductor is a stripline conductor.

28. In a multilayer microwave integrated circuit, an electromagnetic coupling interconnection operative at microwave frequencies between first and second microwave circuit conductors in first and second different layers of said circuit, comprising:

a first ground plane disposed between said first and second layers;

a coupling slot defined in said ground plane, said slot having a midsection extending substantially transverse to said first and second conductors, said slot has an effective electrical length equivalent to one half wavelength at a frequency of operation; and cavity-defining conductive enclosure means for completely surrounding said coupling slot and electromagnetically coupled portions of said first and second microwave circuit conductors to prevent formation of coupling to undesirable transmission modes.

* * * * *